United States Patent [19]

Jungwirth et al.

[11] Patent Number: 4,633,540

[45] Date of Patent: Jan. 6, 1987

[54] TENSION TIE MEMBER

[75] Inventors: Dieter Jungwirth; Gerd Thielen; Otmar Langwadt, all of Munich, Fed. Rep. of Germany

[73] Assignee: Dyckerhoff & Widmann Aktiengesellschaft

[21] Appl. No.: 728,753

[22] Filed: Apr. 30, 1985

[30] Foreign Application Priority Data

Oct. 10, 1984 [DE] Fed. Rep. of Germany ..... 3437107

[51] Int. Cl.[4] ..... E01D 11/00

[52] U.S. Cl. ..... 14/22; 14/21; 52/230

[58] Field of Search ..... 14/21, 22, 14, 23; 52/223 L, 223 R, 230, 445; 403/283, 275, 369

[56] References Cited

U.S. PATENT DOCUMENTS

| | | | |
|---|---|---|---|
| 1,524,939 | 2/1925 | Makowski | 52/445 |
| 2,099,950 | 11/1937 | Whitehead et al. | 403/283 |
| 3,596,330 | 8/1971 | Scott et al. | 403/369 X |
| 3,833,706 | 9/1974 | Edwards | 52/230 X |
| 3,967,421 | 7/1976 | Dufossez | 52/230 X |
| 4,157,602 | 6/1979 | Pennell | 403/275 X |
| 4,449,855 | 5/1984 | Langwadt | 52/223 R X |
| 4,473,915 | 10/1984 | Finsterwalder | 52/230 X |
| 4,557,007 | 12/1985 | Daiguji et al. | 14/22 |

*Primary Examiner*—Stephen J. Novosad
*Assistant Examiner*—Michael A. Goodwin
*Attorney, Agent, or Firm*—Toren, McGeady & Goldberg

[57] ABSTRACT

A tie member includes at least one tension element, such as a steel wire or strand, enclosed within a tubular sheathing. An anchoring unit is located at each end of the tie member for transmitting the tension force to a part of a structure. Each anchoring unit includes an anchor plate with at least one conically shaped bore so that a tension element can be secured in the borehole by a multi-part annular wedge. To provide additional corrosion protection and improve fatigue strength in the anchorage, the tension element is enclosed within a coating of a synthetic resin for its entire length. The inside surface of the wedge is shaped between the ends with a series of coarse or rough teeth with the tips rounded off. When the wedge grips a tension element the synthetic resin material is displaced by the teeth, however, the resin material continues to cover the surface of the tension element not contacted by the teeth so that oxygen is prevented from communicating with the areas where the wedge and tension element are in contact whereby friction corrosion cannot take place.

18 Claims, 12 Drawing Figures

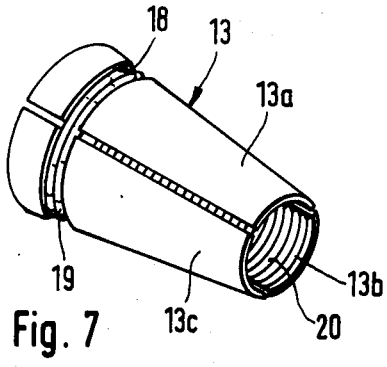
Fig. 7
Fig. 9
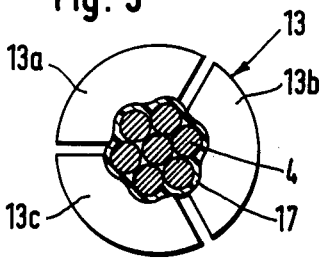
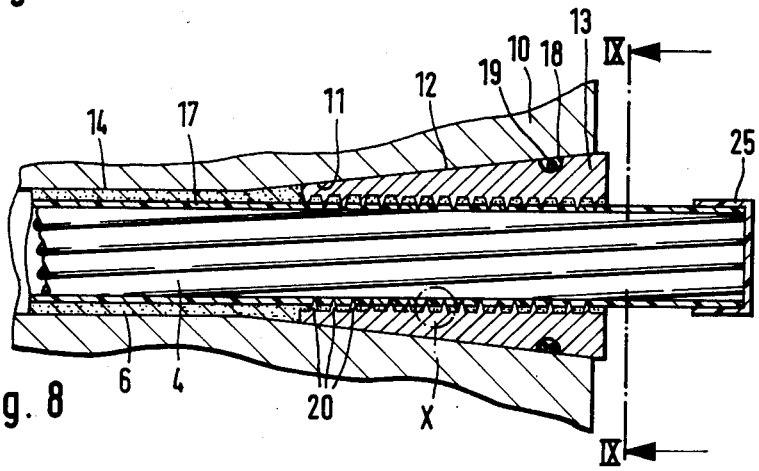
Fig. 8
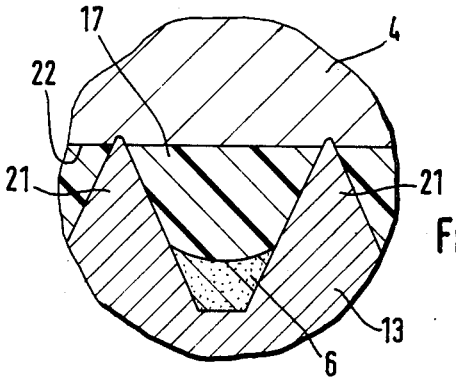
Fig. 10

TENSION TIE MEMBER

BACKGROUND OF THE INVENTION

The present invention is directed to a tie member including at least one tension element, such as a steel wire, a steel strand or the like, enclosed within a tubular sheathing and secured at its opposite ends in anchoring units for transmitting tension force to part of a structure. The anchoring units include an anchor member or plate containing at least one conically shaped borehole with the tension element being anchored in the borehole by a multi-part annular wedge.

Such a tension tie member can be used as a prestressing member for prestressed concrete where an individual prestressing member includes a tension element or a bundle of such elements which may or may not be in composite or bonded action with part of a structure. Alternatively it may be in the form of a tie rod tensioned between and anchored to parts of a structure, such as a diagonal cable for a stayed girder bridge.

Prestressing members for prestressed concrete consist of one or more tension elements guided in part of a structure within a sheathing tube so that it can be moved in its long direction and tensioned after the concrete forming the structure has set and then anchored on a part of the structure. The individual tension elements can remain without any bonding to the part of the structure and, accordingly, can be post-tensioned or can be placed in bonded or composite action with the structure by grouting a hardenable material about the tension element.

Tie rods such as used in civil engineering for anchoring parts of a structure, such as diagonal cables for stayed girder bridges and the like, often are made up of a bundle of individual tension elements, such as steel wires or strands, arranged together in an unsupported region of the tie member within a tubular sheathing. The ends of the tie member are guided through different parts of the structure and anchored on the opposite side of the part from which the tie member enters the structure. Anchoring units for the tie rods include an anchor member, such as an anchor disc or plate, with conically shaped boreholes through which the individual tension elements are inserted and in which they are anchored individually by multi-part annular wedges. One problem experienced with such tie members is that the anchoring units, based on the principle of wedge anchoring, have only a relatively limited fatigue strength and, as a result, are sensitive to fatigue failure. When a tensioned element is anchored, the annular wedges, made up of several wedge sections, are drawn into a conically shaped borehole in the anchor member due to the tensile force acting in the axial direction of the tension element. Clamping forces acting perpendicularly to the axis of the element are produced by the wedge sections and these clamping forces prevent movement of the tension element. The concept underlying such anchorages is that the friction coefficient between the tension element and the wedge is greater than the friction coefficient between the wedge and the conical borehole. As a result, the inside surfaces of the wedge segments are provided with a shaped surface in the form of fine teeth so that the wedge can bite into the surface of the tension element. The teeth are formed by cutting a fine thread in the inside surface of the conically-shaped wedge member before it is divided into the individual wedge sections.

Nevertheless, when dynamic loads are experienced in the structure, such as live loads in a bridge, certain movements, though very limited, take place in the region of the wedge anchorages. Due to such movement friction corrosion can take place when oxygen contacts the tension element with friction corrosion developing and leading to premature failure of the tension elements due to fatigue.

In tie members tensioned between parts of a structure, such as diagonal cables in stayed girder bridges, the tubular sheathing in the unsupported portion of the tie member may be formed of a plastics material tube of polyethylene, or a steel tube. Usually, a steel anchor tube is provided in the anchoring region to absorb the deflection forces which develop when the tension elements are spread as they move toward the anchorage. The open space within the tubular sheathing between the tension elements is filled with an anticorrosive substance, such as grease, or with a hardenable material, such as a cement mortar or a synthetic resin, to protect the tension elements from corrosion. A tie rod of this type can be post-tensioned or replaced after the filling or grouting step.

While thick-walled steel tubes as sheathing in the unsupported region of the tie member can afford the tension elements with good corrosion protection, such tubes cannot be produced in the full length of the tension member and, therefore, must be welded together at joints. Weld seams or joints, however, form weak points where cracks or fractures may occur as a result of fatigue under alternating loads. Plastics material sheathing tubes, such as polyethelene tubes, avoid these problems, however, they are not vapor-tight. Accordingly, such tubes do not provide sufficient corrosion protection for the tension elements within the sheathing if the cement mortar or grout filling the space around the elements happen to develop cracks. The same situation is true for longitudinally seamed, helically wound or longitudinally and transversely welded sheet metal tubes, because such tubes are not absolutely tight in the seams or at the joints or because of possible damage at other locations.

Finally, when the tie member is used as a diagonal cable for stayed girder bridges, the tension elements are left ungrouted for long periods of time, since the final tension force on the cables can only be applied after the entire bridge has been completed. If the space around the tension elements is grouted with a hardenable material, any post-tensioning or relaxing of the tension force which may be required will be made more difficult. Accordingly, a temporary corrosion protection must be provided at the construction site.

SUMMARY OF THE INVENTION

Therefore, the primary object of the present invention is to improve the corrosion protection for the individual tension elements in a tie member of the type mentioned above so that protection is provided temporarily as well as over long periods, and at the same time to improve the fatigue strength of the tie rod in the region of the wedge anchorages.

In accordance with the present invention, each tension element is provided along its full length, including the portion within the anchoring unit, with a synthetic resin coating, such as an epoxy resin, or the like, and the inside surfaces of the wedge are provided with serially arranged coarse teeth with rounded tips which contact the surface of the tension element and penetrate through the coating into contact with the element for producing the anchoring effect.

It is known to provide steel reinforcing members with an epoxy resin coat for corrosion protection. As is well known, epoxy resins harden without any tension, do not crack and possess a high impact strength and abrasion strength. Such material adheres well to most work materials, it does not attack metal and resists atmospheric influences. Such coats can be produced by applying the resin in an electrostatic manner to the surface of the reinforcing elements in the form of dust which is subsequently melted by the application of heat and then hardens.

In accordance with the present invention, by using tension elements, such as wires, rods or strands, coated in this manner with a synthetic resin, it is possible not only to provide a perfect temporary corrosion protection of the individual tension elements during a construction period before the space around the elements is filled with grout, it also affords improved long term corrosion protection. Such long term protection is afforded by a second corrosion protection system, that is, the coating of the tension elements with the synthetic resin within the tubular sheathing and within the corrosion protection material filling the space within the tie members.

A particularly important feature of the invention is that the synthetic resin coating on the tension elements in the region of the wedge anchor not only does not interfere with the transmission of tensile force to the anchor member and thus does not need to be removed, but the coating significantly improves the fatigue strength of the tie member. When multi-part annular wedges are used for anchoring the tension elements, in accordance with the present invention, the shaped sections of the wedges, extending between the ends of the wedges, have a number of coarse teeth so that the tips of the teeth penetrate through the coating and then press into the surface of the steel tension elements by means of the blunted or rounded tooth tips. Due to the radial clamping forces exerted by the wedges, the material of the coating is partially displaced but it continues to coat the surface of the tension element not contacted by the wedge teeth as in its original form, whereby oxygen is prevented from entering the regions in the wedge and tension element in contact with one another. Accordingly, friction corrosion can not develop.

Since the tips of the teeth on the inside surfaces of the wedge sections are slightly blunted or rounded they do not cut into the surface of the tension elements and, accordingly, do not damage the surface which is particularly sensitive especially when formed of strands. Instead, the tips of the teeth only press into the surface. Therefore, the surface layers of the tension element are not cut, but are only deflected whereby a local increase in strength occurs approximately comparable to rolling a thread on a steel rod in a cold working operation.

The improvement of the fatigue strength of the tie member achieved by such a coating is such that it is suitable for most applications. For greater demands, it is possible to press grains of a hard material, such as quartz grains, into the surface of the synthetic resin coating before it completely hardens for increasing its surface roughness and improving the composite or bonding action of the individual tension elements with the hardenable material. As a result, the dynamic portion of loads, such as the live load portion, can be conducted via the composite action to the steel tube and from the tube directly to the part of the structure to which the tie member is anchored without such loads reaching the wedge anchors. Along the unsupported length, the composite action offers a certain reserve, that is, if a strand of the tension element should break its force will be transferred over a short distance to the adjacent strands by the composite action.

Complete corrosion protection includes the protection of the ends of the tensioning elements located in the anchorages which can be provided with a corresponding coat of the synthetic resin, such as an epoxy resin or the like. This protection can be afforded by filling the space containing the protruding ends of the tension elements with the synthetic resin or a prefabricated cap of the resin can be placed on the ends of the tension elements.

The construction of the tubular sheathing for the tie members must be provided by a steel tube in the region of the anchors and such a tube is important for protection against corrosion and for the fatigue strength of the tie member, particularly if it is used as a diagonal cable for a stayed girder bridge. It is advisable, however, in the anchor region, as well as the region where the tie member extends through the part of the structure, that the tubular sheathing includes at least one steel tube separate from the part of the structure so that the tie rod is longitudinally movable relative to the structure.

Within the anchor region, the steel tube can be provided with a profiled cross-section so that forces resulting from the composite of bonding action between the tension element and a hardenable material inserted after tensioning, such as a cement mortar, can be introduced into the steel tube and through it into the structure. For the transfer of such forces, the steel tube in the anchor region, preferably at its end spaced from the anchor member is provided with an inwardly stepped construction, that is, its diameter is reduced.

In addition, the steel tube in the anchor region can be arranged so that the anchor member or disc is supported against the adjacent end of the tube, that is, the end located on the opposite side of the structure from the point where the tie member proceeds into the structure. At the location where the tie member enters the structure, remote from the anchored disc, the tube has an increased thickness portion which forms a support surface for supporting the tie member relative to the part of the structure to which the tie member is anchored.

Furthermore, it is preferable to connect the steel tube in the anchor region with a steel tube adjoining it which adjoining tube extends over the region where the tie member extends into the part of the structure so that it is longitudinally movable so that rotational movement can be effected prior to grouting the space around the tension elements with the hardenable material. Such a connection is preferably a plug connection where the annular intermediate space between the steel tubes which fit one into the other is sealed by an elastic material.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

Figure 1:
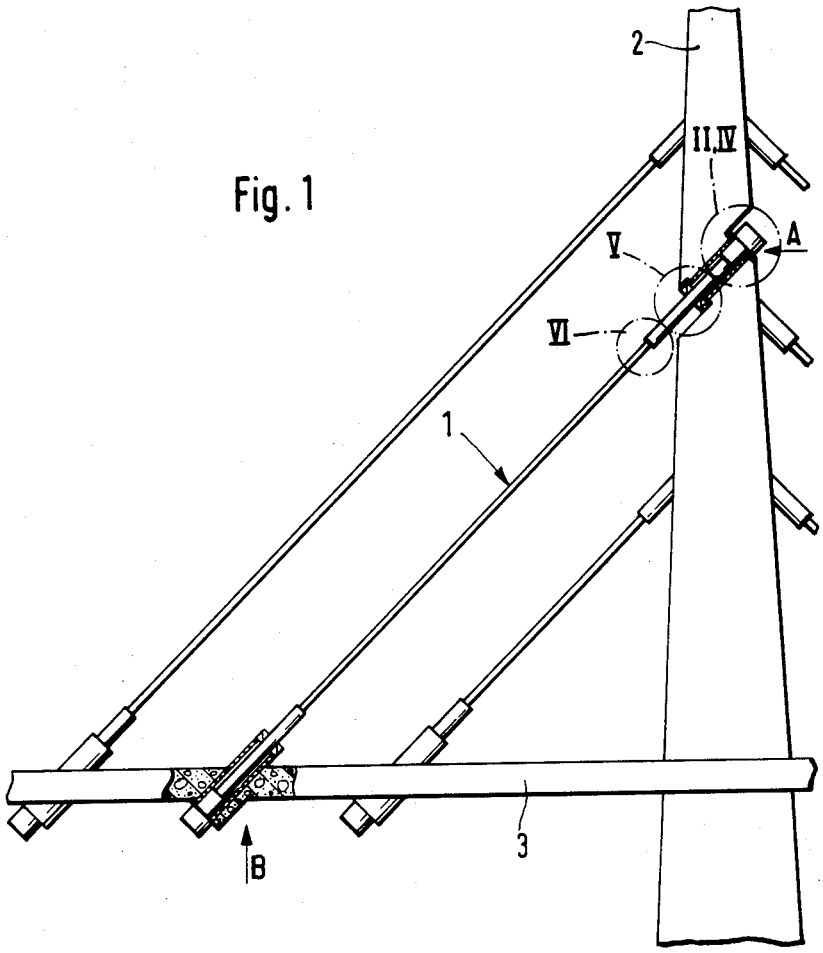
FIG. 1 is a schematic elevational view of a tie member embodying the present invention in the form of a diagonal cable in a stayed girder bridge.
Figures 2A, 2B:
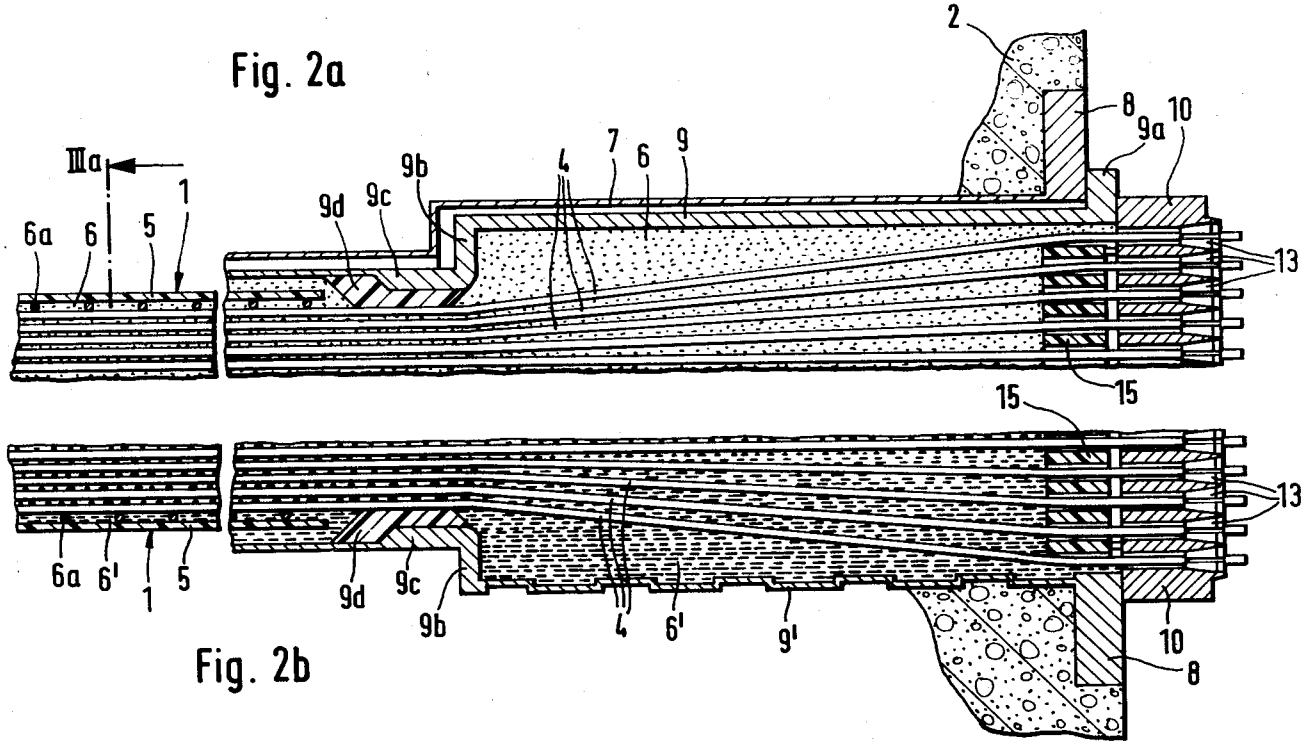

FIGS. *2a* and *2b* are longitudinally extending partial sectional views of two different embodiments of the present invention for the anchor region of a diagonal cable according to the detail II in FIG. 1;

FIG. *3a* is a partial cross-sectional view taken along the line III*a* in FIG. *2a*.

FIG. *3b* is a cross-sectional view, on an enlarged scale, of the detail III*b* in FIG. *3a;*

Figure 4:
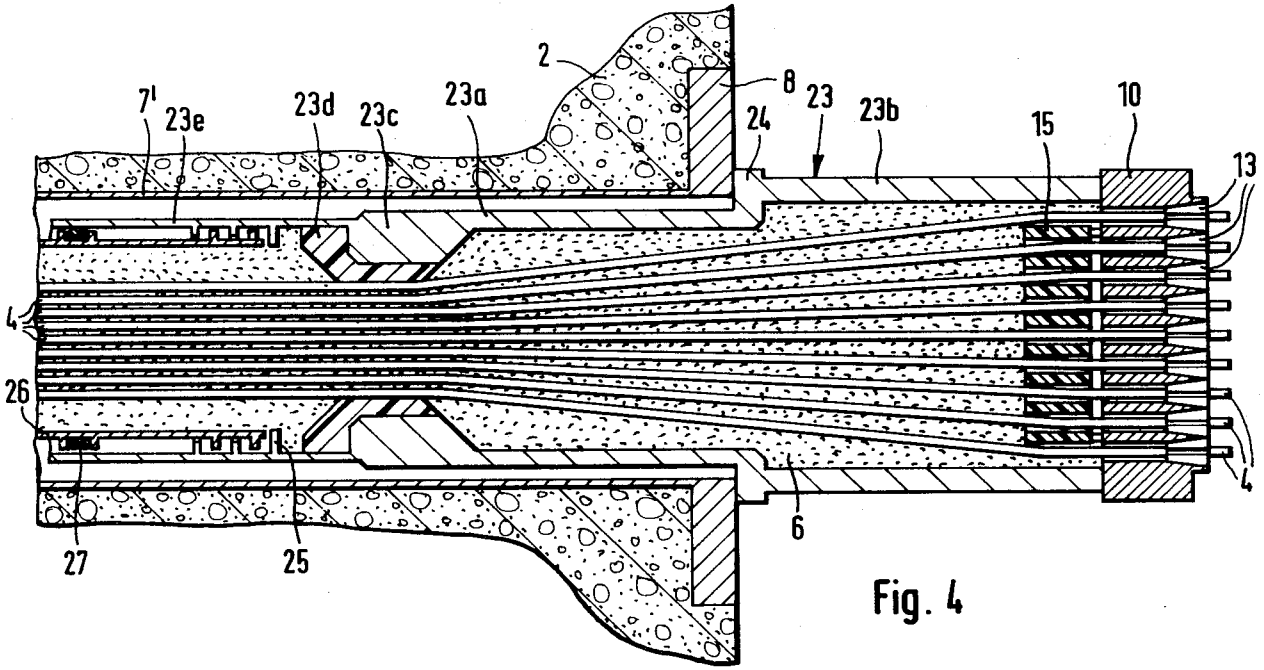
Figure 5:
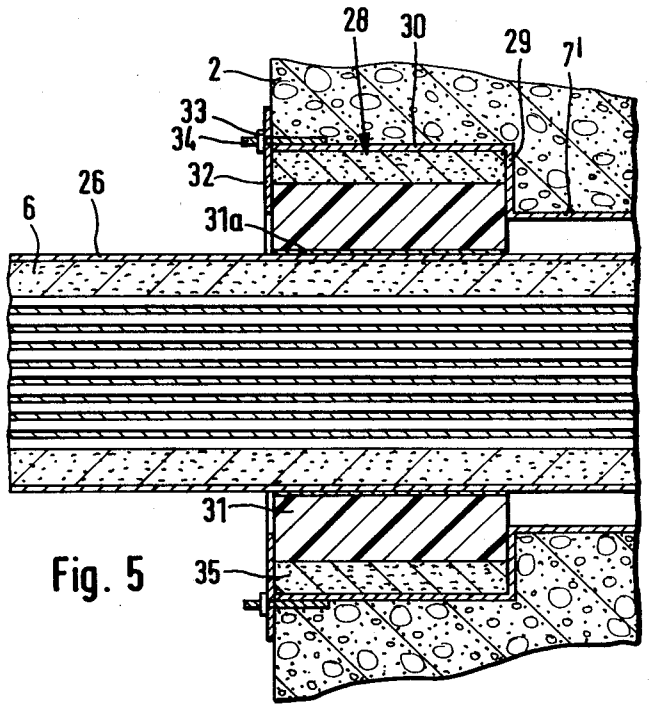

FIG. 4 is a longitudinal sectional view through another embodiment of the anchor region of a diagonal cable in accordance with the present invention based on detail IV in FIG. 1;

FIG. 5 is a partial longitudinal sectional view in the region where the diagonal cable enters into the part of the structure to which the cable is anchored, based on detail V in FIG. 1.

Figure 6:
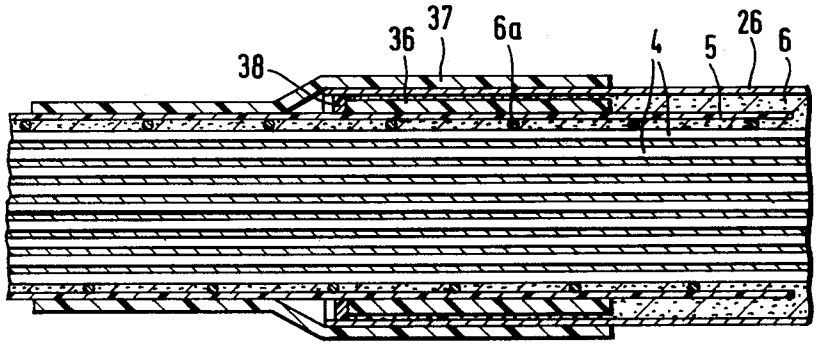

FIG. 6 is a partial longitudinal sectional view through the diagonal cable at the transition from the structure into the unsupported region of the tie member in accordance with the detail VI in FIG. 1;

FIG. 7 is a perspective view of a multi-part annular wedge for anchoring a tension element in accordance with the present invention;

FIG. 8 is a longitudinal sectional view through an anchor for a tension element utilizing the wedge shown in FIG. 7;

FIG. 9 is an end view taken along the line IX—IX in FIG. 8; and

FIG. 10 is a sectional view on an enlarged scale of the detail X as shown in FIG. 8.

DETAILED DESCRIPTION OF THE INVENTION

In the drawing the invention is illustrated as one of several diagonal cables 1 in a stayed girder bridge. In FIG. 1 an elevational view is shown of a portion of a stayed girder bridge with a reinforced concrete tower 2 and a roadway girder 3 formed of reinforced concrete or prestressed concrete or of a combination of the two. The invention is not limited to stayed girder bridges or to the materials mentioned for constructing the tower and the roadway girder.

The diagonal cable 1 passes through a channel or duct in each of the tower 2 and the roadway girder 3 so that it is longitudinally movable. Cable 1 is secured at an anchorage A on the opposite side of the tower from where the cable extends downwardly to the roadway girder. Another anchorage B is located at the underside of the girder 3. Aside from slight differences between an active tension anchorage and a passive stationary anchorage, the anchorages are, in principle, similarly constructed.

Diagonal cable 1 is made up of a bundle of individual tension elements 4, in the present instance steel strands are used, and the elements are arranged within a tubular sheathing 5 so that they are parallel with one another. The space remaining between the tension elements 4 and the interior of the tubular sheathing 5 is filled with a hardenable material 6, such as cement mortar. The minimum required covering of the strands or tension members 4 by the hardenable material is assured by drawing a spiral of steel wire 6*a* into the tubular sheathing so that it laterally surrounds the individual tension elements, note FIGS. *2a*, *2b* and FIGS. *3a*, *3b*.

In FIGS. *2a* and *2b* longitudinal sections are illustrated of two embodiments of the anchorage A, based on detail II in FIG. 1. In FIG. *2a* a diagonal cable is anchored so that it is, as a whole, movable longitudinally relative to the tower 2 so that it can be replaced. FIG. *2b* displays a diagonal cable with its tubular sheathing embedded or secured within the concrete forming the tower 2 in the region of the anchorage.

In FIG. *2a* a tubular member 7 forms an opening through the tower 2 and forms a duct or passageway for the diagonal cable 1 passing through the tubular member. The tubular member 7 is secured within the concrete forming the tower 2. At one side of the tower 2, the tubular member 7 is connected to an abutment plate 8 which extends laterally outwardly from the tubular member. The abutment plate 8 is located on the side of the tower 2 where the cable 1 is anchored. As the parallel tension elements 4 proceed through the tubular member 7 toward the anchorage, the tension elements or strands are spread outwardly and extend through a steel anchor tube 9 which forms the tubular sheathing for the diagonal cable 1 in the region of the anchorage. The anchor tube 9 has a radially outwardly extending flange 9*a* supported against the abutment plate 8 with the anchor tube forming a support surface for the anchor plate 10. Spaced from the flange 9*a*, anchor tube 9 has a radially inwardly extending flange or shoulder 9*b* ending in a short axially extending region 9*c* having a smaller diameter than the part of the pipe extending between the flange 9*a* and the shoulder 9*b*. At the inside surface of the region 9*c* there is a deflecting ring 9*d* formed of a plastics material, such as PTFE that is, polytetrafluoroethylene or TEFLON. Region 9*c* of the anchor tube 9 receives the deflecting forces developed during the spreading of the strands 4 with the deflecting ring 9*d* providing a soft or nonrigid support for the strands and facilitating their longitudinal movement during tensioning. The open space within the anchor tube 9, similar to the space within the tubular sheathing 5, is filled with a hardenable material 6 which is injected after the tension elements 4 are tensioned.

In FIG. *2b* an anchor tube 9' is provided with a shaped or profiled surface for increasing the bonding action with the concrete forming the tower 2. The replaceability of the diagonal cable can be ensured in this arrangement only when the space within the tubular sheathing 5 and within the anchor tube 9' is filled with a nonhardenable corrosion protection material 6', such as grease.

In each of these embodiments the anchor plate 10 has a plurality of boreholes 11 extending through it, note FIG. 8, with each borehole having an axially extending conically shaped section 12 arranged to seat an annular wedge 13. Ahead of the cylindrically shaped section, that is, to the left as viewed in FIG. 8, the borehole has a cylindrical section 14. A spacer ring 15 formed of a plastics material is located adjacent the face of the anchor plate 10 directed into the anchor tube 9. The purpose of the spacer ring 15 is to deflect the tension elements 4 spread toward the anchor plate back into a parallel arrangement as the elements extend into the anchor plate, note FIGS. *2a* and *2b*. Spacer ring 15 can be connected with the anchor plate 10 as a unit to facilitate installation and to secure it in position. The transition from the anchor tubes 9, 9' to the tubular sheathing in the free or unsupported region of the diagonal cable has a sheathing tube of plastics material, not shown.

Figure 3A:
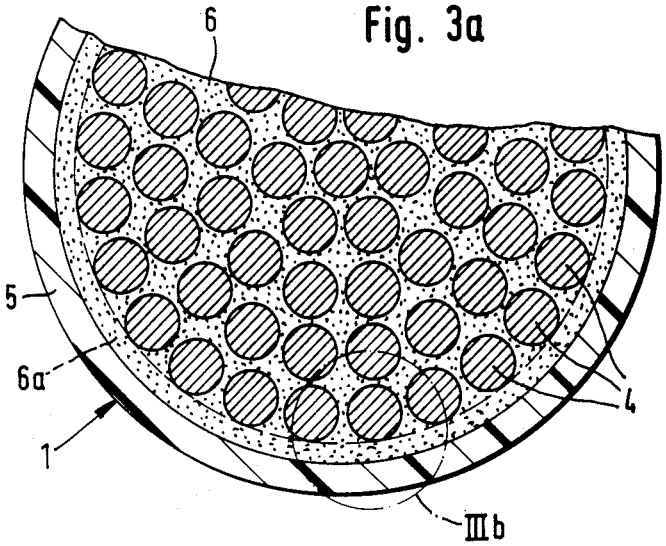
Figure 3B:
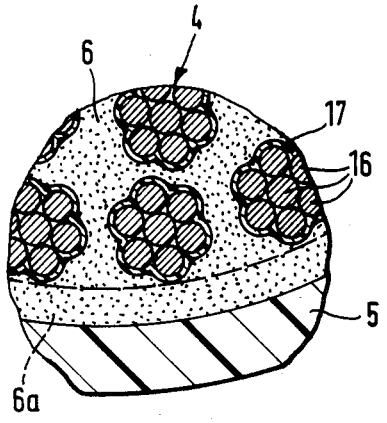

In FIG. 3*a* a cross-section is displayed of the diagonal cable in its unsupported region and FIG. 3*b* is an enlarged sectional view of the detail IIIb in FIG. 3*a*. FIG. 3*b* shows that the tension elements 4, each made up of a number of individual wires 16, are enclosed in a coating 17 of a synthetic resin, such as an epoxy resin. Coating 17 extends along the entire length of the tension elements. To improve the bonding action of the coating 17 with the hardenable material 6, such as cement mortar, the coating can be provided with shaped parts, quartz grains or the like, which are pressed into the coating. The operation of pressing parts into the coating is preferably carried out at a time when the resin has not fully hardened. A spacer in the form a wire spiral 6*a* maintains the required distance between the tension elements 4 and the inside of the sheathing tube 5.

The anchorage itself is shown in detail in FIGS. 7 to 10. The wedges used for anchoring the strands 4, in accordance with the invention, are made up of three wedge sections 13*a*, 13*b* and 13*c* resiliently secured together by a spring ring 19 inserted into an annular groove extending around the outside of the wedge sections. The inside surface of the wedge sections 13*a*, 13*b*, 13*c* are provided with a tooth section 20 extending between the ends of the wedge extending transversely of its axis. The tooth section 20 is made up of individual teeth 21 in the form of a coarse thread cut into the inside surface of the wedge before it is divided into individual wedge sections 13*a*, 13*b*, 13*c* by a number of radial cuts. The tips of the teeth 21 are not left with sharp edges in the form resulting from the thread cutting step, rather they are rounded off as shown in FIG. 10. The rounding off action occurs when the wedge sections, after case-hardening, are placed with loose abrasive bodies of a ceramic material, for instance glass powder, alumina of the like, in a grinding mill or drum so that they are continuously circulated. As a result, the sharp edge tips are ground down or rounded off.

Since the coating 17 is located along the entire length of the tension elements 4, that is, in the region of the anchorage, the wedges 13 for anchoring the tension elements relative to the anchor plate 10 are placed in a conventional manner, note FIG. 8. As the clamping force increases, the tips of the teeth 21 penetrate into the coating and pass through it and press against the surface 22 of the tension element 4, note FIG. 10. The material forming the coating 17 is displaced due to the clamping action and flows into the thread grooves between the teeth. The thread grooves are dimensioned so as to be sufficiently large to receive the coating material. Any open spaces which remain will be filled during the grouting operation with a hardenable material 6. The depth of the teeth 21 and the slope of their flanks must be selected so that the tips of the teeth penetrate through the coating 17 and end up in contact with the surface of the tension elements.

According to the invention, the tooth arrangement 20 in the wedges must be coarser by at least twice as compared to conventional wedges. Preferably, the depth of the teeth is approximately 2.0 to 3.0 mm with the inclination or slope of the flanks in a range of approximately 45° to 60°. With such dimensions, the teeth are spaced apart. The grinding or rounding off of the tips of the teeth prevents them from cutting into the surface of the tension element when they clamp the tension elements under a working load. An asymmetrical thread in which the thread grooves are considerably flattened relative to the thread tips so as to provide a trapezoidal section are particularly useful. Preferably, the base of the grooves between adjacent threads is flat or planar, note FIG. 10.

With such wedges, it is possible to provide a particularly secure anchorage with the further advantage that the areas where the tips of the teeth 21 contact the surface of the tension element 4, are enclosed on all sides by the synthetic resin forming the coating 17 so that the coating effectively prevents oxygen from coming into contact with the surfaces of the tension elements in the region where the teeth clamp the surfaces of the elements. To prevent any corrosive materials from penetrating to the surfaces of the tension elements, the ends of the elements projecting outwardly from the wedges are enclosed or sealed by a cap 25 formed of a synthetic resin.

The longitudinal sections through the anchorage A, according to details IV, V and VI in FIGS. 1, and 4 to 6 display an embodiment of an anchorage where the dynamic part of the anchoring force is taken up by the bonding action with the concrete of the tower before the force reaches the actual wedge anchorage. In FIG. 4 an anchor tube 23 is located within the duct or opening through the tower 2 and projects outwardly from the tower on the side where the anchorage A is located. Anchor tube 23 has a flange-like extension 24 with the extension separating the anchor tube into a smaller diameter inner part 23*a* located within the duct through the tower and a larger diameter outer part 23*b* projecting outwardly from the tower to the anchor plate 10. The inner part 23*a* of the anchor tube 23 is located within a tubular member 7' embedded in the concrete forming the tower 2. The flange-like extension 24 of the anchor tube 23 bears against abutment plate 8 formed at the end of the tubular member 7' located at the surface of the tower 2 on the side where the anchorage A is located. The anchor force is transmitted from the anchor tube 23 through the abutment plate 8 to the tower 2.

At the end of the inner part 23*a* of the anchor tube 23 located more remotely from the anchor plate 10, an increased thickness part 23*c* is provided projecting inwardly from the inner surface of the inner part 23*a*. The increased thickness part 23*c* laterally encloses the tension elements 4 at the location where they commence to be spread outwardly in the direction toward the anchor plate 10. The increased thickness part 23*c* receives the deflecting forces generated during the tensioning operation. The inside surface of the increased thickness part 23*c* is lined with a deflecting ring 23*d* of a plastics material, such as PTFE. The ring 23*d* provides a soft or nonrigid support for the tension elements and facilitates their longitudinal movement during the tensioning operation.

At its end in the tubular member 7' within the tower 2, the anchor tube is formed by an extension section 23*e* projecting from the increased thickness part 23*c*. The extension section is joined with a radially inner steel tube 26 which laterally encloses the tension elements 4 in the region where the diagonal cable 1 extends into the structure, that is, into the tower 2, so that the cable is longitudinally movable. Steel tube 26 extends into the extension section 23*e* until it reaches a stop 25 projecting radially inwardly from the inside surface of the extension section. The inside surface of the extension section 23*e* and the outside surface of the steel tube 26 are in radially spaced relation and the annular gap between them is sealed by sealing rings 27 formed of an elastic material. This plug-like connection between the anchor tube 23 and the steel tube 26 acts as an articulated joint at least prior to grouting the space within the anchor tube with cement mortar 6 or grout. With this plug-like connection it is possible to adjust the inclination of the anchor tube 23 or of the steel tube 26 to compensate for any installation tolerances.

In detail V in FIG. 1, the diagonal cable 1 passes into the tower for subsequent entry into the anchorage A and FIG. 5 shows this arrangement on an enlarged scale. As the tubular member 7' approaches the entry side of the tower 2 it widens radially outwardly and forms an annular chamber 28 by means of an annular flange 29 projecting radially outwardly from the tubular member 7' and an axially extending annular chamber wall 30. A bearing ring 31 formed of an elastomeric material, such as neoprene, is located within the annular chamber 28 closely encircling the steel tube 26. The bearing ring 31 permits a certain amount of movement in the radial direction during the installation of the diagonal cable 1 through the annular chamber 28. When the diagonal cable is secured in its final position and is finally tensioned, which determines its final sag, the annular chamber 28 is closed at the entry surface of the tower 2. The closure of the annular chamber 28 is effected by a circular ring disc 32 secured by means of nuts 33 onto bolts 34 fixed to the outside surface of the chamber wall 30. By pressing the ring disc 32 against the bearing ring 31, the bearing ring is upset in the axial direction and the annular chamber is sealed. As shown in FIG. 5, an annular space remains between the radially outer surface of the bearing ring 31 and the radially inner surface of the chamber wall 30 and it is filled with a hardenable material 35, such as a cement grout. As a result, the bearing ring 31 is fixed in position and provides a perfectly defined lateral support for the diagonal cable in the region where it enters the tower 2. Longitudinal displaceability of the diagonal cable following the injection of the hardenable material 35 into the space between the bearing ring and the chamber wall is ensured by a sliding layer **31*a* positioned between the radially inner surface of the bearing ring 31 and the outer surface of the steel tube 26**.

The connection of the steel tube 26 to the tubular sheathing 5 of the diagonal cable in its unsupported region spaced outwardly from the tower is illustrated in FIG. 6 which shows, on an enlarged scale, the detail VI in FIG. 1. The plastics material tubular sheathing 5 has a spiral **6*a* located within its interior extending around its inside surface and acting as a spacer between the radially outer tension elements 4 and the inside surface of the tubular sheathing. The tubular sheathing is connected with the steel tube 26 by a sleeve bushing 37 formed of a plastics material. The connection of the sleeve bushing 37 with the tubular sheathing 5 and the steel tube 26 is effected by weld seams. The connection with the steel tube 26 can be effected by a plastics material shell formed on the steel tube. Where the tubular sheathing 5 extends into the radially outer steel tube 26, a sleeve 36 of an elastomeric material extends around the outer surface of the tubular sheathing and a seal 38 is provided adjacent the end of the steel tube 26 in contact with the sleeve 36. The seal 38 is formed of a durable elastics material. The space between the tubular sheathing 5 and the steel tube 26 is filled with a hardenable material 6 and the seal 38 prevents any flow of the grout into contact with the inside surface of the sleeve bushing 37**.

In this anchorage, the tension developed in the tension member within the anchor tube 23 due to live loads are conducted into the anchor tube and because of the bonding action directly into the tower structure due to the composite or bonding action between the individual tension elements and the hardenable material. Due to the multiple-axis tensioning produced in the anchorage region because of the fan-shaped spreading of the tension elements 4, the forces transmitted by the bonding action between the coated tension elements and the hardenable material are absorbed.

While specific embodiments of the invention have been shown and described in detail to illustrate the application of the inventive principles, it will be understood that the invention may be embodied otherwise without departing from such principles.

We claim:

1. A tie member comprising at least one axially elongated tension element, such as a steel wire, steel strand and the like, a tubular sheathing laterally enclosing said at least one tension element, an anchoring unit at each end of said tension element for transferring the tension force to a structure, said anchoring unit comprising an anchor member having at least one conically shaped borehole therethrough, a multi-part annular wedge engageable within said borehole for securing said tension element therein, wherein the improvement comprises a coating of a synthetic resin completely laterally enclosing said at least one tension element between the ends thereof including the portion of said tension element located within said wedges, each said annular wedge has a pair of end surfaces spaced apart in the axial direction of said tension element extending transversely of the axial direction of said tension element, a conically shaped outside surface, and an inside surface arranged to contact the surface of said tension element extending between said spaced end surfaces of said annular wedge, said inside surface of said wedge being shaped in the direction between said spaced ends for forming a series of teeth with the tips of said teeth being rounded off and arranged to penetrate through said coating into contact with said tension element.

2. A tie member, as set forth in claim 1, wherein said series of teeth comprises a thread cut in the inside surface of said wedge in which the base of the thread grooves located between said teeth is formed as a flat surface.

3. A tie member, as set forth in claim 2, wherein said thread grooves have a trapezoidal cross-section between adjacent said teeth.

4. A tie member, as set forth in claim 1, wherein grains of a hard material are embedded in the surface of said coating with the grains projecting outwardly from the surface of said coating for increasing the surface roughness thereof.

5. A tie member, as set forth in claim 4, wherein said grains of a hard material are formed of quartz.

6. A tie member, as set forth in claim 1, wherein said at least one tension element being located within and spaced inwardly from said tubular sheathing and a hardenable material filled into the space within said tubular sheathing around the outside of said at least one tension element.

7. A tie member, as set forth in claim 6, wherein said hardenable material is a cement grout.

8. A tie member, as set forth in claim 1, wherein the opposite ends of said at least one tension element in the region of said anchor member being coated with a synthetic resin for protection against corrosion.

9. A tie member, as set forth in claim 8, wherein the ends of said at least one tension element being coated with an epoxy resin.

10. A tie member, as set forth in claim 8, wherein said ends of said at least one tension element are covered with a prefabricated cap formed of a plastics material.

11. A tie member, as set forth in claim 1, wherein said tie member comprises a diagonal cable for a stayed girder bridge comprising a plurality of tension elements, and said tubular sheathing comprises a steel anchor tube in the region adjacent to said anchoring unit.

12. A tie member, as set forth in claim 11, wherein said tubular sheathing is arranged to extend through a part of the structure toward said anchor member and in the region of the structure adjacent said anchor member said tubular sheathing comprises at least one axially extending steel tube with the axis thereof extending in general parallel to the axially elongated said tension element and arranged in spaced relation relative to the structure so that said tie member is longitudinally movable relative to the structure.

13. A tie member, as set forth in claim 12, wherein a hardenable material fills the space within said steel tube around said tension elements so that forces can be transmitted from tension elements through said hardenable material to said steel tube with said steel tube being arranged to be supported on the structure through which said tie member extends.

14. A tie member, as set forth in claim 13, said steel tube has a first end and a second end with said first end bearing against said anchor member and said steel tube at a position spaced from said first end being stepped inwardly and forming a reduced diameter section relative to the section of said steel tube adjoining said anchor member.

15. A tie member, as set forth in claim 14, wherein the first end of said steel tube is supported against said anchor member, said first end of said steel tube and said anchor member being arranged to be spaced outwardly from the structure to which the tie member is anchored, and said steel tube at a location spaced axially from the first end thereof has a flange-like section extending transversely of the axis of said steel tube and said flange-like section is arranged to be supported against the structure to which said tie member is anchored.

16. A tie member, as set forth in claim 15, wherein a second steel tube is interengaged with said steel tube in the region where the tie member extends through the structure and said steel tube and said second steel tube are interengaged so that said second steel tube is axially movable relative to said steel tube and angular displacement between said steel tube and said second steel tube is provided prior to filling the interior of said steel tube and second steel tube with hardenable material.

17. A tie member, as set forth in claim 16, wherein said second steel tube extends into said steel tube in radially spaced relation in the manner of a plug-like connection.

18. A tie member, as set forth in claim 17, wherein the radially inner surface of said steel tube and the radially outer surface of said second steel tube form an annular space therebetween and means located within said annular space for forming a seal between said steel tube and said second steel tube, and said seal means being formed of an elastic material.

* * * * *